US009644444B2

(12) United States Patent
Jurena

(10) Patent No.: US 9,644,444 B2
(45) Date of Patent: May 9, 2017

(54) LOAD-SHARING RAM PACKER FOR RAM TYPE BLOWOUT PREVENTERS

(75) Inventor: Johnny Everett Jurena, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 922 days.

(21) Appl. No.: 13/227,628

(22) Filed: Sep. 8, 2011

(65) Prior Publication Data

US 2013/0062540 A1 Mar. 14, 2013

(51) Int. Cl.
*E21B 33/06* (2006.01)

(52) U.S. Cl.
CPC ..... *E21B 33/062* (2013.01)

(58) Field of Classification Search
CPC ..... E21B 33/062
USPC ..... 251/1.1, 1.3; 166/363, 364
See application file for complete search history.

(56) References Cited

U.S. PATENT DOCUMENTS

| | | | | |
|---|---|---|---|---|
| 3,817,326 | A * | 6/1974 | Meynier, III | 166/55 |
| 4,076,208 | A * | 2/1978 | Olson | 251/1.3 |
| 4,313,496 | A * | 2/1982 | Childs et al. | 166/55 |
| 4,323,256 | A | 4/1982 | Miyagishima et al. | |
| 4,580,626 | A * | 4/1986 | Jones | 166/55 |
| 5,515,916 | A * | 5/1996 | Haley | 166/55 |
| 6,244,336 | B1 * | 6/2001 | Kachich | 166/55 |
| 7,354,026 | B2 * | 4/2008 | Urrutia | 251/1.3 |
| 7,703,739 | B2 * | 4/2010 | Judge et al. | 251/1.3 |
| 2003/0024705 | A1 | 2/2003 | Whitby et al. | |
| 2004/0066003 | A1 | 4/2004 | Griffin et al. | |
| 2006/0021749 | A1 | 2/2006 | Schaeper | |
| 2010/0243926 | A1 * | 9/2010 | Weir | 251/1.3 |

OTHER PUBLICATIONS

PCT International Search Report and Written Opinion for PCT/US2012/052867, dated Dec. 14, 2012.

* cited by examiner

*Primary Examiner* — Umashankar Venkatesan
(74) *Attorney, Agent, or Firm* — Chamberlain Hrdlicka

(57) ABSTRACT

A ram block includes an upper ram arm, a lower ram arm, a packer channel, and a packer disposed at least partially within the packer channel. The packer includes a skeletal member that is configured to couple to the upper ram arm and the lower ram arm to oppose vertical separation of the ram arms.

22 Claims, 7 Drawing Sheets

LOAD-SHARING RAM PACKER FOR RAM TYPE BLOWOUT PREVENTERS

BACKGROUND

In hydrocarbon drilling operations, a blowout preventer ("BOP") is used to form a pressure-tight seal at the top of a well and prevent the escape of formation fluids. A ram BOP achieves pressure control through the operation of hydraulically operated ram blocks. The ram blocks are grouped in opposing pairs and are forced together as a result of the hydraulic operation. Certain types of ram BOPs employ ram blocks designed to shear through pipe in the wellbore (e.g., drillpipe, a liner, or a casing string), hang the pipe off on the ram blocks, and seal the wellbore. Each ram block may include a ram packer designed to form a seal when the ram blocks are brought together. The ram blocks may each have arms that extend in towards the wellbore such that when the ram blocks are brought together, the ram arms mate in a way the resists upward deflection of the ram blocks due to well pressure.

When the ram blocks are brought together to shear a pipe in the wellbore, the pipe has a tendency to flatten before being sheared, effectively increasing the diameter of the pipe. Certain pipes may experience more flattening before being sheared, for example due to an increased wall section thickness. It is desirable to reduce the thickness of the ram arms to provide clearance for the increased effective diameter of the pipe prior to shearing while minimizing the overall form factor of the ram blocks. However, the ram arms experience high loads and reducing the thickness of the ram arms may result in an unacceptable amount of yielding or vertical separation from one another, possibly leading to failure of the BOP.

SUMMARY OF DISCLOSED EMBODIMENTS

In one embodiment, a ram block includes an upper ram arm, a lower ram arm, a packer channel, and a packer disposed at least partially within the packer channel. The packer includes a skeletal member that is configured to couple to the upper ram arm and the lower ram arm to oppose vertical separation of the ram arms.

In another embodiment, a ram block includes a ram arm, a packer channel, and a packer disposed at least partially within the packer channel. The packer includes a skeletal member that is configured to couple to an upper ram arm and a lower ram arm of an opposing ram block to oppose vertical separation of the ram arms of the opposing ram block.

In yet another embodiment, a blowout preventer includes a body having a throughbore, a pair of opposing hydraulically actuated ram blocks comprising a first and second ram block. Each of the ram blocks includes a packer channel and a packer disposed at least partially within the packer channel and including a skeletal member. The blowout preventer also includes a ram actuator coupled to each of the ram blocks. The first ram block includes an upper ram arm and a lower ram arm and the skeletal member of the first ram block is configured to couple to the upper ram arm and the lower ram arm to oppose vertical separation of the ram arms. Additionally, the skeletal member of the second ram block is configured to couple to the upper ram arm and the lower ram arm of the first ram block to oppose vertical separation of the ram arms of the first ram block.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
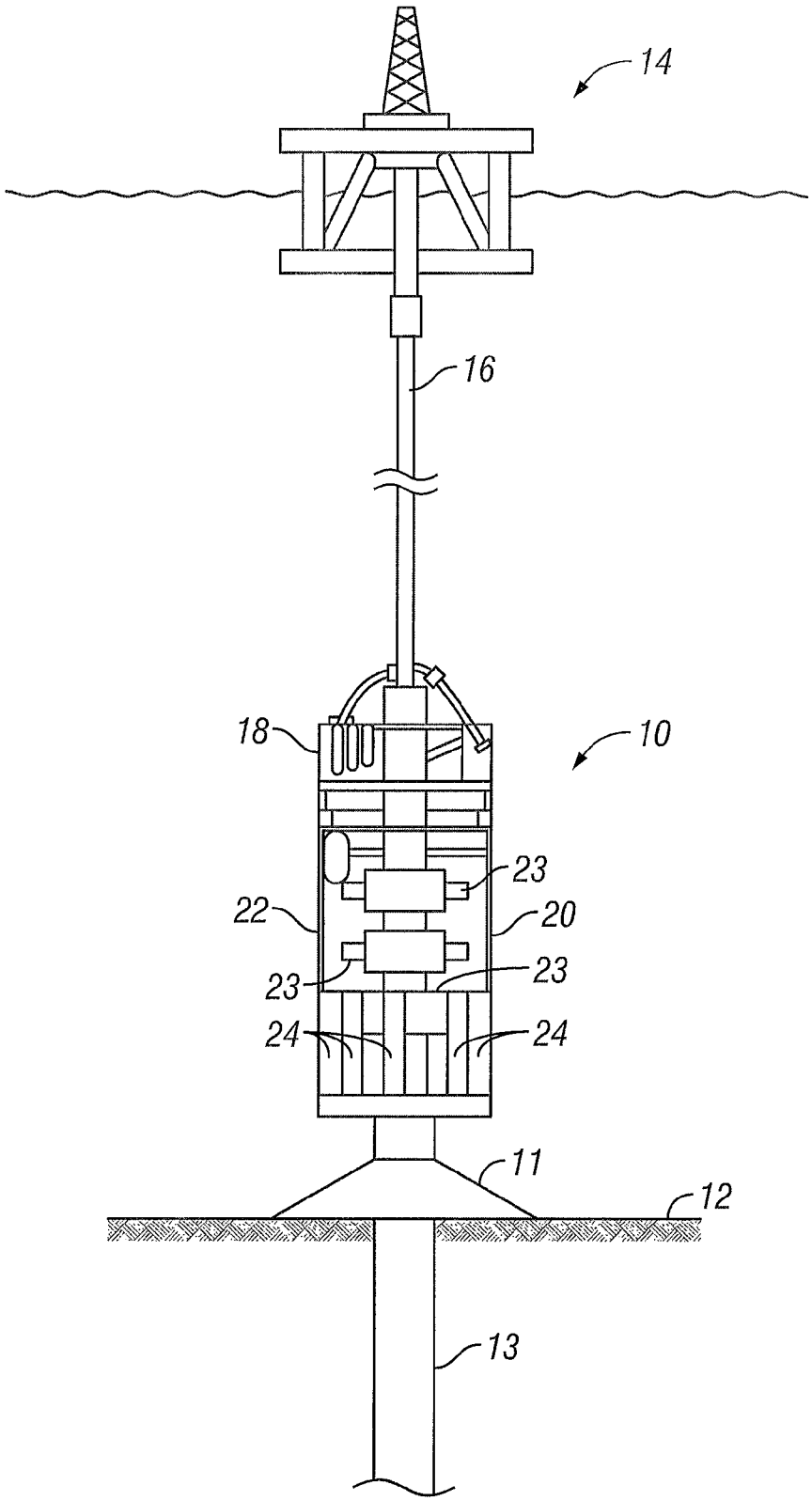
FIG. 1 shows a schematic view of an embodiment of a subsea hydrocarbon well in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms connect, engage, couple, attach, or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a subsea BOP stack assembly 10 is assembled onto a wellhead assembly 11 on the sea floor 12. The BOP stack assembly 10 is connected in line between the wellhead assembly 11 and a floating rig 14 through a subsea riser 16. The BOP stack assembly 10 provides emergency pressure control of drilling/formation fluid in the wellbore 13 should a sudden pressure surge escape the formation into the wellbore 13. The BOP stack assembly thus prevents damage to the floating rig 14 and the subsea riser 16 from fluid pressure exiting the seabed wellhead.

The BOP stack assembly 10 includes a BOP lower marine riser package 18 that connects the riser 16 to a BOP stack package 20. The BOP stack package 20 includes a frame 22, BOPs 23, and accumulators 24 that may be used to provide back up hydraulic fluid pressure for actuating the BOPs 23. In some embodiments, the BOPs 23 are ram-type BOPs, such as those shown in FIGS. 2*a* and 2*b*.

Figure 2A:
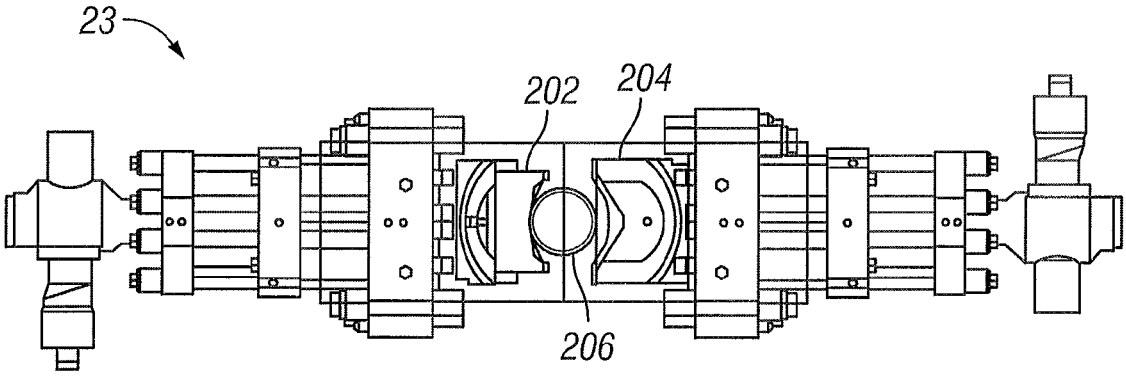
FIG. 2*a* shows a vertical view of a blowout preventer with housing removed in accordance with various embodiments.

Referring now to FIG. 2*a*, a vertical view of the throughbore of a BOP 23 with the housing removed is shown. The BOP 23 includes a pair of opposing ram blocks 202, 204. The ram blocks 202, 204 are urged together in response to hydraulic actuation and when urged together, in some embodiments, are designed to shear a pipe 206 that is in the wellbore between the ram blocks 202, 204. The ram blocks 202, 204 are discussed in further detail below.

Figure 2B:
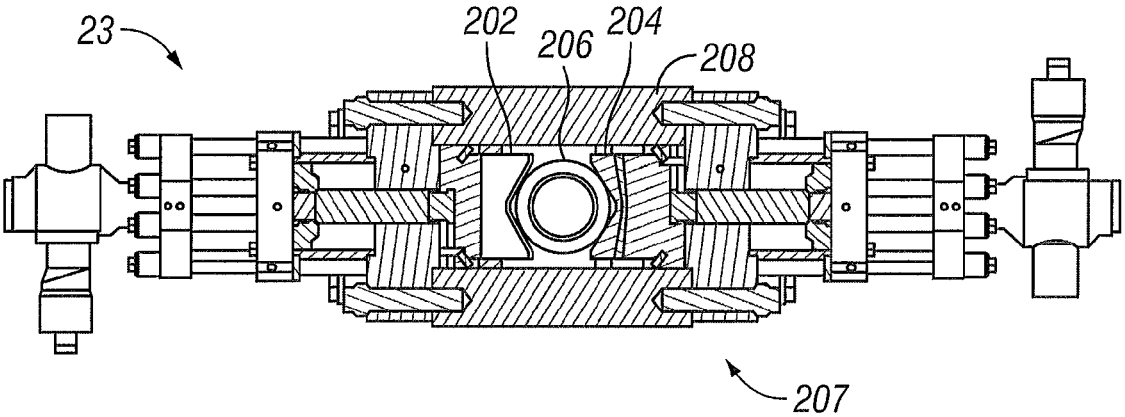
FIG. 2*b* shows an alternate vertical view of a blowout preventer in accordance with various embodiments.

FIG. 2*b* shows the BOP 23 as in FIG. 2*a*, however with the addition of a BOP housing 207 that includes side walls 208 of a ram cavity. The side walls 208 may serve to guide the motion of the ram blocks 202, 204 as well as support the ram blocks 202, 204. Additionally, the side walls 208 may at least partially prevent the ram blocks 202, 204 from deflecting upward in response to contained wellbore pressure.

Figure 3:
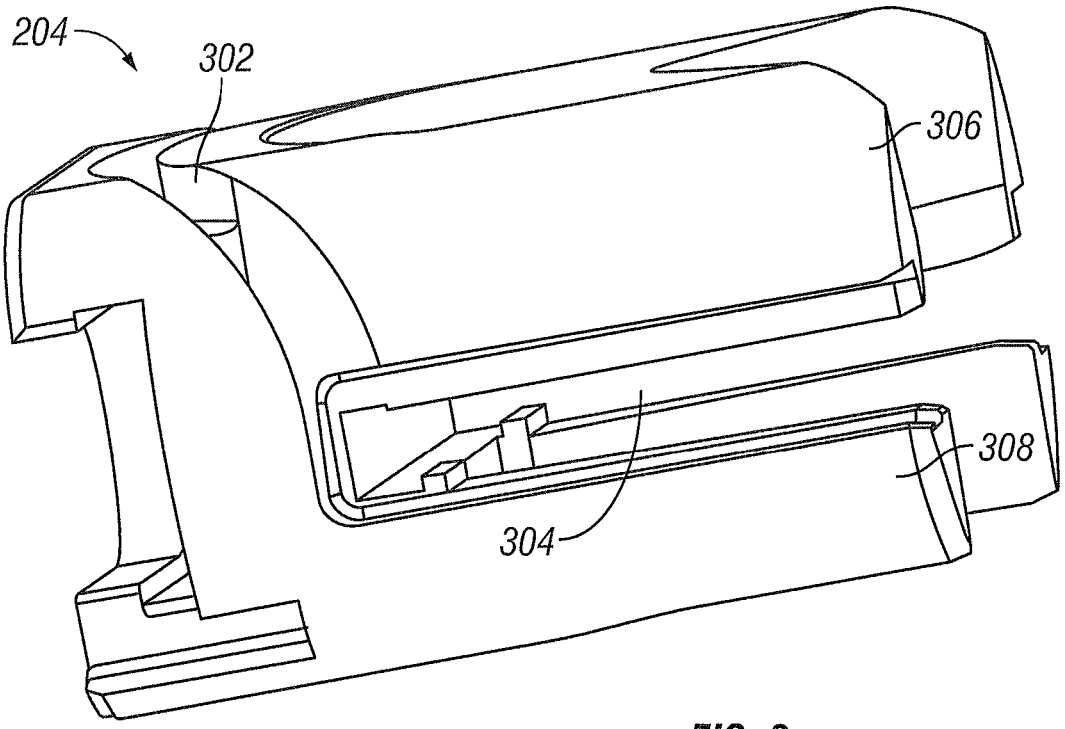
FIG. 3 shows a ram block in accordance with various embodiments.

Turning now to FIG. 3, one of the ram blocks 204 is shown without a ram packer installed. The ram block 204 includes a packer channel 302, which would house the ram packer, and a side cutout 304 configured to house the ram packer as well as receive a ram arm from an opposing ram block (not shown) when the ram blocks are actuated. The ram block 204 also includes an upper ram arm 306 and a lower ram arm 308. Although the ram block 204 includes two upper ram arms and two lower ram arms as shown, only one pair (i.e., upper and lower ram arms 306, 308) will be discussed for simplicity.

As explained above, when the ram blocks are actuated, the side cutout 304 between the ram arms 306, 308 receives a ram arm of the opposing ram block 20 in a tongue and groove type interface. This interface strengthens the links between the ram blocks 202, 204 and helps prevent upward lateral deflection of the ram blocks in response to contained wellbore pressure. However, as explained above, there are advantages to minimizing the size of the ram arms 306, 308. For example, to allow the ram blocks 202, 204 to shear larger diameter pipes 206 without the flattened pipe interfering with the ram arms 306, 308, which could prevent the ram blocks 202, 204 from closing completely and cause the BOP 23 to fail.

One skilled in the art appreciates that reducing the size of the ram arms 306, 308 may reduce their resistance to fatigue. Additionally, the ram arms must still contain wellbore pressure as well as withstand force generated by the increase in pressure caused by the packers of each ram block 202, 204 coming together. Furthermore, while increasing the length of the ram arms 306, 308 provides a more robust tongue and groove connection, it also reduces the fatigue resistance as a result of the cantilevered nature of the ram arms 306, 308. This combination of factors increases the likelihood that the ram arms 306, 308 vertically separate (i.e., that the ram arm 306 is forced laterally upward relative to the ram arm 308 and that the ram arm 308 is forced laterally downward relative to the ram arm 306). Again, this lateral separation is a product of both the wellbore pressure and the force generated by the packers of each ram block 202, 204 coming together.

Figure 4A:
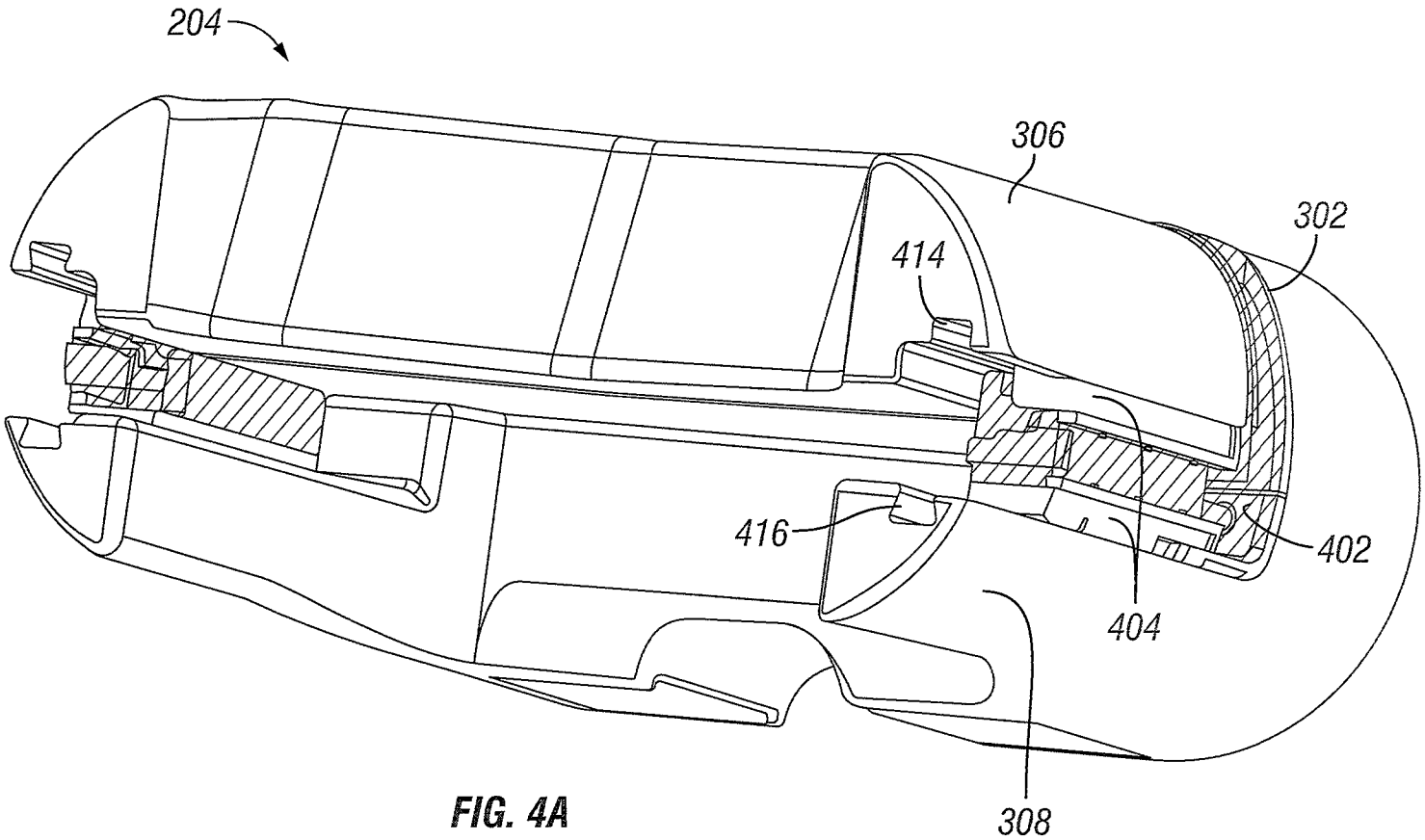
FIG. 4 shows a ram block including a packer in accordance with various embodiments.

Referring now to FIG. 4*a*, the ram block 204 is shown as in FIG. 3. However, a packer 402 is shown at least partially disposed in the packer channel 302. The packer channel 302 serves to contain the packer pressure generated when the packers of the ram blocks 202, 204 are forced together. The packer 402 includes a skeletal member 404 that couples to the upper ram arm 306 and the lower ram arm 308. In some embodiments the packer 402 is molded around the skeletal member 404 (as in FIG. 4*a*). In other embodiments the skeletal member 404 surrounds the packer 402. The skeletal member 404 alleviates the weakness of the cantilevered ram arms 306, 308 by opposing tensile forces generated by the vertical separation of the ram arms 306, 308. In other words, the skeletal member 404 adds robustness to the ram arms 306, 308 by holding them together. The skeletal member 404 may be manufactured from, for example, a material having the same or similar Young's modulus compared to the ram block 204.

Figure 4B:
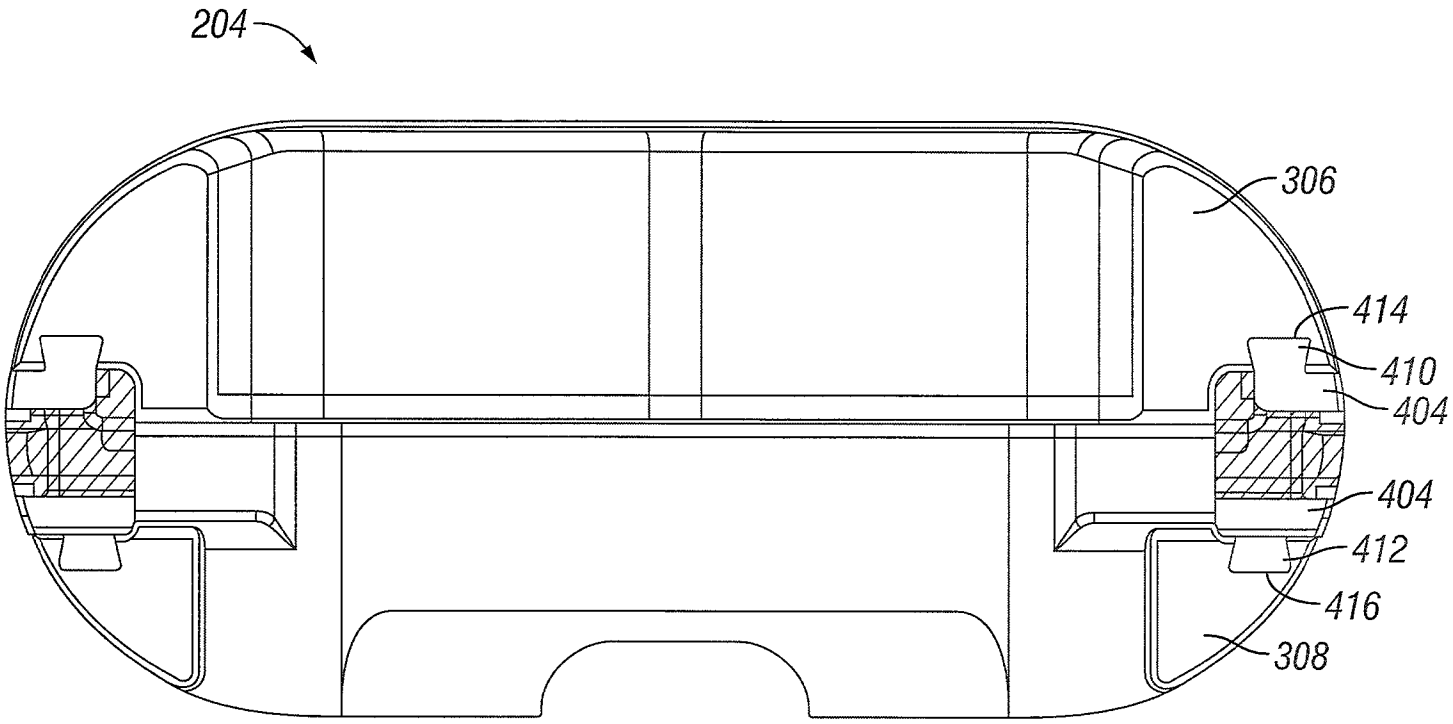

Additionally, the skeletal member 404 may couple to the ram arms 306, 308 in many ways. FIG. 4*b* shows the ram block 204 along the z-axis. In FIG. 4*b*, for example, a connection via a "dovetail" joint where a protrusion 410, 412 of the skeletal member 404 interacts with a corresponding slot 414, 416 along the length of the ram arm 306, 308, respectively. Referring back to FIG. 4*a*, the slots 414, 416 in the ram arms 306, 308 are shown in greater detail. Alternately, a protrusion of the ram arm 306, 308 interacts with a corresponding slot along the length of the skeletal member 404. In another example, the connection may be by fasteners. Effectively coupling the ram arms 306, 308 mitigates the above-mentioned stresses that result from the cantilevered nature of the ram arms 306, 308. Additionally, load may be evenly distributed across each of the ram arms 306, 308 rather than acting unevenly on one of the pair. Thus, the inclusion of the skeletal member 404 enables the ram arms 306, 308 to be reduced in size while maintaining resistance to fatigue caused by packer pressure and contained wellbore pressure. The reduction in size, in turn, enables the BOP 23 to shear larger-diameter pipe without the potential for the flattened pipe to be stuck between the ram blocks 202, 204 prior to being sheared, causing the BOP 23 to be stuck open.

Figure 5:
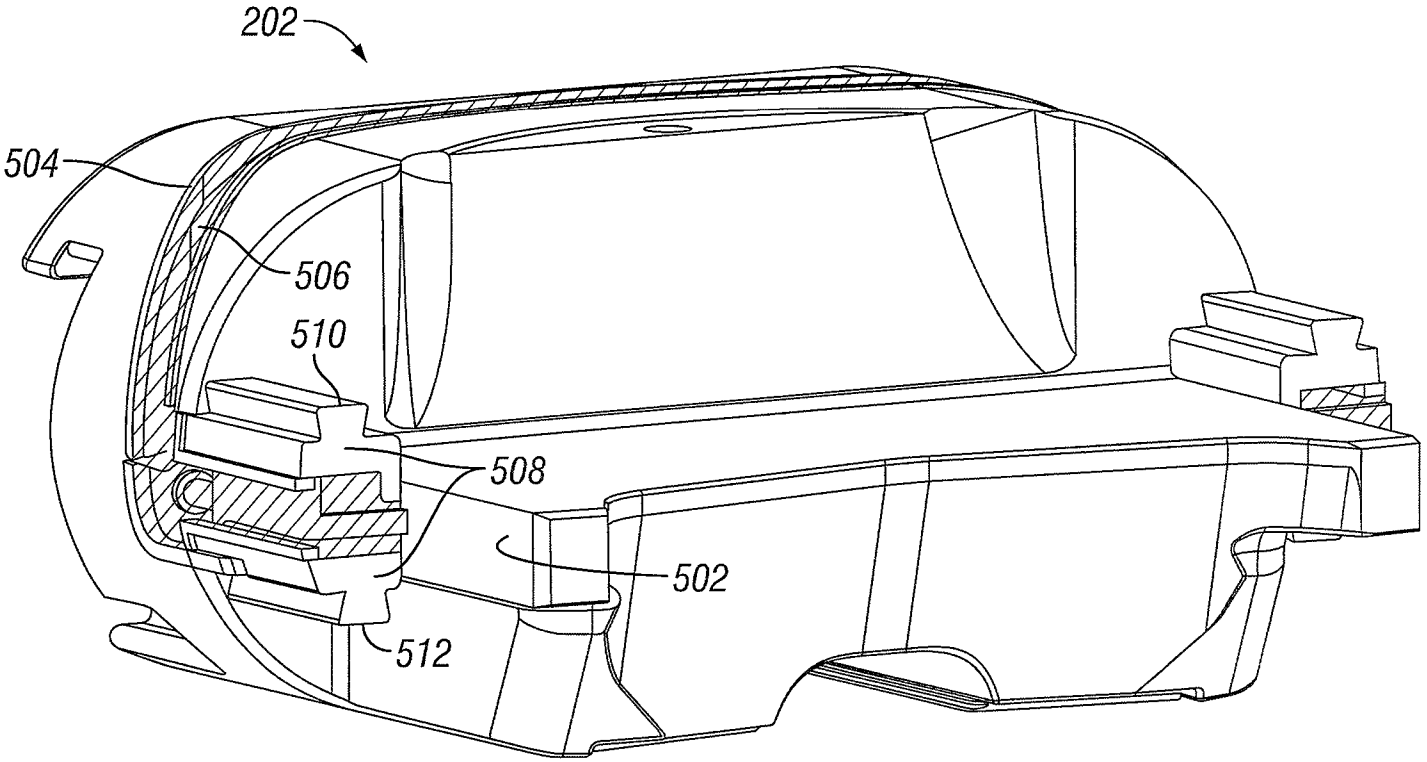
FIG. 5 shows an alternate ram block in accordance with various embodiments.

FIG. 5 shows the ram block 202 in further detail. As with the ram block 204, the ram block 202 includes a ram arm 502, a packer channel 504, and a packer 506 disposed at least partially in the packer channel 504. As above, the packer channel 504 serves to contain the packer pressure generated when the packers 402, 506 of the ram blocks 202, 204 are forced together. The ram arm 502 is configured to mate with the side cutout 304 between the upper and lower ram arms 306, 308 of the ram block 204 in a tongue and groove type interface.

The packer 506 includes a skeletal member 508. As shown, the packer 506 is molded around the skeletal member 508; however, in other embodiments, the skeletal member 508 surrounds the packer 506 and serves to contain the packer 506. In some embodiments, and as shown in FIG. 5, the skeletal member 508 also may couple to the upper and lower ram arms 306, 308 of the other ram block 204 when the ram blocks 202, 204 are urged together. Similar to the skeletal member's 404 connection to the ram arms 306, 308, the connection between the skeletal member 508 and the ram arms 306, 308 may be via a "dovetail" joint where protrusions 510, 512 of the skeletal member 508 interact with the slots 414, 416 of the ram block 204 (shown in FIG. 4*b*) when the ram blocks 202, 204 are urged together. Alternately, a protrusion of the ram arm 306, 308 interacts with a corresponding slot along the length of the skeletal member 508. Thus, the skeletal member 508 further reinforces the cantilevered ram arms 306, 308 by opposing tensile forces generated by the vertical separation of the ram arms 306, 308. In other words, the skeletal member 508 adds additional robustness to the ram arms 306, 308 by holding them together.

Figure 6:
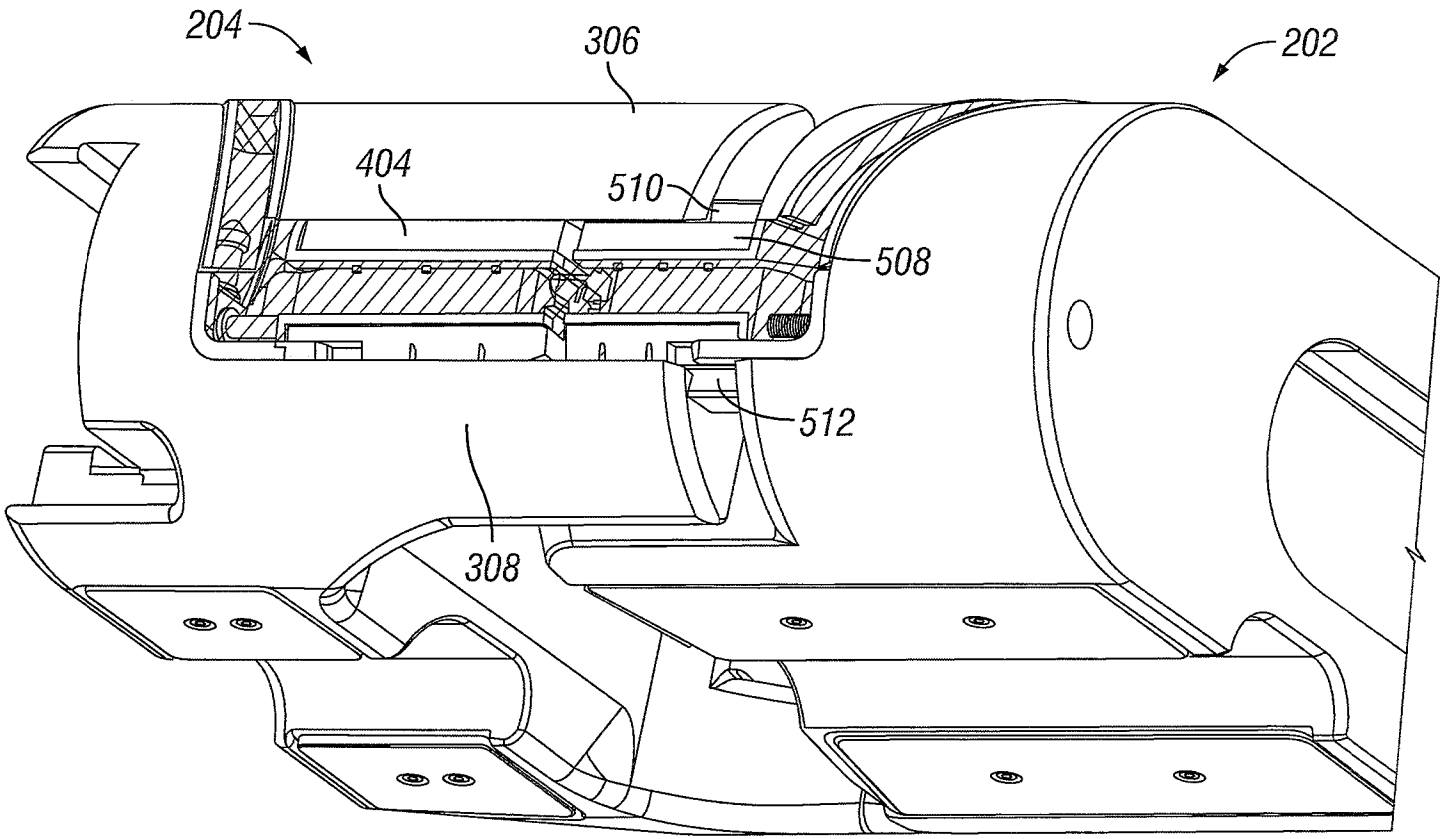
FIG. 6 shows interaction between a pair of ram blocks in accordance with various embodiments.

FIG. 6 shows the ram blocks 202, 204 in a partially closed configuration. In FIG. 6, the protrusions 510, 512 of skeletal member 508 are shown interacting with the slots in the ram arms 306, 308 of the ram block 204. Although not shown, the skeletal member 404 also interacts with the slots in the ram arms 306, 308 as shown in FIG. 4*b*. Thus, both skeletal members 404, 508 reinforce the cantilevered ram arms 306, 308 by opposing tensile forces generated by the vertical separation of the ram arms 306, 308.

While specific embodiments have been shown and described, modifications can be made by one skilled in the art without departing from the spirit or teaching of this invention. The embodiments as described are exemplary only and are not limiting. Many variations and modifications are possible and are within the scope of the invention. For example, the disclosed interaction between the skeletal members and the ram arms is intended to apply to any support structure that is integrated into a packer to resist forces acting on cantilevered portions of a ram block. As another example, the coupling between the skeletal structure and the ram arms may take many different forms other than those mentioned above. Still further, it is not necessary that both of a set of ram blocks include the described skeletal structure. Accordingly, the scope of protection is not limited to the embodiments described, but is only limited by the claims that follow, the scope of which shall include all equivalents of the subject matter of the claims.

What is claimed is:

1. A ram block, comprising:
an upper ram arm;
a lower ram arm;
a packer channel; and
a packer disposed at least partially within the packer channel and comprising a skeletal member; and
wherein the skeletal member is configured to couple to the upper ram arm and the lower ram arm to oppose vertical separation of the ram arms.

2. The ram block of claim 1 wherein at least one ram arm comprises a slot to receive a longitudinal protrusion of the skeletal member, such that tensile forces caused by vertical separation of the ram arms are opposed by the skeletal member.

3. The ram block of claim 1 wherein at least one ram arm comprises a protrusion to engage a longitudinal slot of the skeletal member, such that tensile forces caused by vertical separation of the ram arms are opposed by the skeletal member.

4. The ram block of either claim 2 or 3 wherein the skeletal member couples to at least one of the upper ram arm and the lower ram arm by a dovetail joint.

5. The ram block of claim 1 wherein the packer is molded around the skeletal member.

6. The ram block of claim 1 wherein the skeletal member at least partially surrounds the packer.

7. The ram block of claim 1 wherein the upper and lower ram arms are configured to receive a ram arm of an opposing ram block in a tongue and groove configuration, thereby preventing upward deflection of the ram block in response to applied wellbore pressure.

8. A ram block, comprising:
a ram arm;
a packer channel;
a packer disposed at least partially within the packer channel and comprising a skeletal member; and
wherein a portion of the packer that is the skeletal member is configured to couple to an upper ram arm and a lower ram arm of an opposing ram block to oppose vertical separation of the ram arms of the opposing ram block.

9. The ram block of claim 8 wherein the skeletal member comprises a longitudinal protrusion to mate with a slot in at least one of the ram arms of the opposing ram block, such that tensile forces caused by vertical separation of the ram arms of the opposing ram block are opposed by the skeletal member.

10. The ram block of claim 8 wherein the skeletal member comprises a longitudinal slot to mate with a protrusion in at least one of the ram arms of the opposing ram block, such that tensile forces caused by vertical separation of the ram arms of the opposing ram block are opposed by the skeletal member.

11. The ram block of either claim 9 or 10 wherein the skeletal member couples to at least one of the upper ram arm and the lower ram arm of the opposing ram block by a dovetail joint.

12. The ram block of claim 8 wherein the ram arm is configured to mate between the upper and lower ram arms of the opposing ram block in a tongue and groove configuration, thereby preventing upward deflection of the ram block in response to applied wellbore pressure.

13. The ram block of claim 8 wherein the packer is molded around the skeletal member.

14. The ram block of claim 8 wherein the skeletal member at least partially surrounds the packer.

15. A blowout preventer, comprising:
a body having a throughbore;
a pair of opposing hydraulically actuated ram blocks comprising a first and second ram block, each ram block comprising:
a packer channel; and
a packer disposed at least partially within the packer channel and comprising a skeletal member;
a ram actuator coupled to each of the ram blocks; and
wherein the first ram block comprises an upper ram arm and a lower ram arm and the skeletal member of the first ram block is configured to couple to the upper ram arm and the lower ram arm to oppose vertical separation of the ram arms;
wherein the skeletal member of the second ram block is configured to couple to the upper ram arm and the lower ram arm of the first ram block to oppose vertical separation of the ram arms of the first ram block.

16. The blowout preventer of claim 15 wherein at least one ram arm of the first ram block comprises a slot to receive a longitudinal protrusion of the skeletal member, such that tensile forces caused by vertical separation of the ram arms are opposed by the skeletal member.

17. The blowout preventer of claim 15 wherein at least one ram arm of the first ram block comprises a protrusion to engage a longitudinal slot of the skeletal member, such that tensile forces caused by vertical separation of the ram arms are opposed by the skeletal member.

18. The blowout preventer of either claim 16 or 17 wherein the skeletal member couples to at least one of the upper ram arm and the lower ram arm by a dovetail joint.

19. The blowout preventer of claim 15 wherein the skeletal member comprises one or more fasteners to couple to the upper ram arm or the lower ram arm.

20. The blowout preventer of claim 15 wherein at least one of the packers is molded around the corresponding skeletal member.

21. The ram block of claim 15 wherein at least one of the skeletal members at least partially surrounds the corresponding packer.

22. The blowout preventer of claim 15 wherein the upper and lower ram arms of the first ram block are configured to receive a ram arm of the second ram block in a tongue and groove configuration, thereby preventing upward deflection of the ram blocks in response to applied wellbore pressure.

* * * * *